US010653200B1

(12) United States Patent
Burns et al.

(10) Patent No.: US 10,653,200 B1
(45) Date of Patent: May 19, 2020

(54) HEAD AND NECK RESTRAINT FOR AUTOMOBILE OCCUPANTS

(71) Applicants: Adam Jacob Burns, Norman, OK (US); Scott Burns, Fletcher, OK (US)

(72) Inventors: Adam Jacob Burns, Norman, OK (US); Scott Burns, Fletcher, OK (US)

( * ) Notice: Subject to any disclaimer, the term of this patent is extended or adjusted under 35 U.S.C. 154(b) by 0 days.

(21) Appl. No.: 15/682,199

(22) Filed: Aug. 21, 2017

Related U.S. Application Data

(60) Provisional application No. 62/377,338, filed on Aug. 19, 2016.

(51) Int. Cl.
*A42B 3/04* (2006.01)
*A41D 13/05* (2006.01)

(52) U.S. Cl.
CPC ..... *A42B 3/0473* (2013.01); *A41D 13/0512* (2013.01)

(58) Field of Classification Search
CPC .... A42B 3/06; A42B 3/0473; A41D 13/0512; A41D 13/0568
See application file for complete search history.

(56) References Cited

U.S. PATENT DOCUMENTS 3,873,996 A * 4/1975 Varteressian ..... A42B 3/0473 2/421
4,219,193 A * 8/1980 Newman ..... A61F 5/055 128/DIG. 23
5,371,905 A * 12/1994 Keim ..... A42B 3/0473 2/413
5,483,698 A * 1/1996 Douglas, Jr. ..... A41D 13/0512 2/462
6,009,566 A * 1/2000 Hubbard ..... A41D 13/0512 2/421
6,971,123 B2 * 12/2005 Weaver ..... A42B 3/0473 2/411
8,272,074 B1 9/2012 Ashline
8,375,473 B2 2/2013 Celona et al.
8,393,017 B2 * 3/2013 Sheren ..... A41D 13/0512 2/425
8,539,648 B2 9/2013 Stiles et al.
8,850,625 B2 10/2014 Stiles
9,351,529 B1 5/2016 Ashline
9,415,711 B2 8/2016 Darnell
(Continued)

*Primary Examiner* — Tajash D Patel
(74) *Attorney, Agent, or Firm* — James F. Lea, III; Gable Gotwals

(57) ABSTRACT

A protective device and method of use includes a collar portion for positioning behind the neck of a wear and a right leg and a left leg connected to the collar portion that extend over the chest of a wearer. The collar portion and legs may be constructed of a single piece. An upwardly extending portion extends upwardly behind the head of a wearer and is movably affixed to the collar portion. A shock absorber has a first end attached to the collar portion and a second end attached to the upwardly extending portion to resist forward motion of the upwardly extending portion. A connector, such as a strap, communicates the upwardly extending portion to a helmet. Therefore, deceleration of the upwardly extending portion and a connected helmet is affected by the shock absorber, thereby mitigating the effects of a sudden deceleration as is often experienced during an auto accident.

29 Claims, 2 Drawing Sheets

(56) References Cited

U.S. PATENT DOCUMENTS

| | | | | |
|---|---|---|---|---|
| 2008/0209617 | A1* | 9/2008 | Castillo | A41D 13/0512 2/461 |
| 2014/0020163 | A1 | 1/2014 | Stiles et al. | |
| 2017/0013905 | A1* | 1/2017 | Cook | A42B 3/0473 |

* cited by examiner

HEAD AND NECK RESTRAINT FOR AUTOMOBILE OCCUPANTS

CROSS REFERENCE TO RELATED APPLICATIONS

This application claims the priority of U.S. Provisional Patent Application No. 62/377,338 titled "HEAD AND NECK RESTRAINT FOR AUTOMOBILE OCCUPANTS," filed Aug. 19, 2016, the contents of which are hereby incorporated by reference.

FIELD OF THE INVENTION

The invention relates to automobile passenger restraints. More particularly, the invention relates to a helmet attached restraint for restraining a wearer's head during rapid deceleration, such as may be experienced in a crash.

BACKGROUND OF THE INVENTION

A potential cause of death among race car drivers is injuries that result from violent head movements during a crash. In a typical crash, the driver's body is secured to the vehicle seat with seat belts. However, during a rapid deceleration, a driver's head can continue to move forward, causing a basilar skull fracture resulting in serious injury or immediate death.

A head restraint device is desirable to prevent neck injuries for drivers in race cars. The head restraint device prevents the head of a driver from whipping forward in a crash. The head restraint device additionally prevents excessive rotational movement of the head. Ideally, the head restraint device provides these protections without otherwise restricting movement of the neck.

During use of known head restraint devices, e.g., the "HANS device", a vehicle driver is able to move his or her head as normal while operating the vehicle. However, in a crash, the device restricts head movements that would otherwise exceed the normal articulation range of the skeletal/muscular system and cause severe injury. Without the HANS device, in a crash, a driver's body is decelerated by the seatbelt while the head maintains velocity until it is decelerated by the neck. The HANS device maintains the relative position of the head to the body and transfers energy to the drivers chest, torso, shoulder, seatbelts, and seat as the head is decelerated.

A typical HANS device is shaped like a U, wherein the back of the U locates behind the neck of the driver. The two legs of the U lie flat along the front of the chest over the pectoral muscles. The device is supported primarily by the shoulders. A typical HANS device is only attached to the driver's helmet, but is not attached the belts, the driver's body, or to the seat. The helmet is attached to the HANS device at two connection locations on each side of the helmet.

When wearing a typical racing harness, the harness belts that cross the driver's upper body pass over the HANS device on the driver's shoulders and the belts buckle at the center of the driver's abdomen. Therefore, the HANS device is secured with the body of the driver, not the seat.

Despite the substantial improvement in driver safety afforded by the use of the HANS device, drivers involved in high speed accidents may experience a concussion when using the device. The majority of concussions in auto racing do not result from the head coming in contact with objects within the vehicle. Instead, concussions experienced by auto racing drivers while using the HANS device may be caused by the straps that are affixed to a driver's helmet. During a crash impact, when the driver's head moves forward and fully extends the straps, the helmet and the driver's skull within the helmet come to an abrupt stop, while the driver's brain continues to move forward until the brain impacts the front of the skull. Therefore, without anything touching the helmet or even getting a scratch, the driver can get a very serious concussion.

SUMMARY OF THE INVENTION

The head restraint device of the invention includes a collar portion having legs extending therefrom, wherein the legs wrap around the neck of a driver and down in front of a driver's chest. On the back of the collar portion, a headrest portion is provided that extends upwards behind the driver's head. In a one embodiment, the collar portion and the leg portions are constructed of a single piece.

The device is placed over the shoulders of the driver and then the driver is secured within the vehicle, e.g., with a 5 point harness. The straps of the harness lay over the legs of the brace. Once the straps are tightened, the straps hold the brace securely to the driver's body.

In one embodiment, approximately ¾ of the way up the headrest portion, straps are connected from the headrest portion to two connecting points or anchors on the back or sides of the driver's helmet. In the event of an impact, the straps limit how far the driver's head can move forwardly or to the side.

In the head restraint device of the invention, a shock absorber is added to the brace. In one embodiment, the head restraint device is constructed of two pieces, e.g., a collar portion and a headrest portion. The two pieces may be connected together at a hinge. Two bolts and a small shock absorber additionally connect the collar portion and the headrest portion. The shock absorber may be valved extremely light for slow speed extension, to add comfort to the driver when getting strapped into the car and for maintaining a driver's ability to look around. However, at high speed extension, the valving is stiff enough to withstand the forces found in a major impact.

By implementing the shock absorber and specially designed head restraint assembly, deceleration of the helmet is significantly slowed during a crash. The head restraint of the invention softens the blow to the brain while maintaining the same features provided by existing HANS devices.

DETAILED DESCRIPTION OF THE PREFERRED EMBODIMENTS

Figure 1:
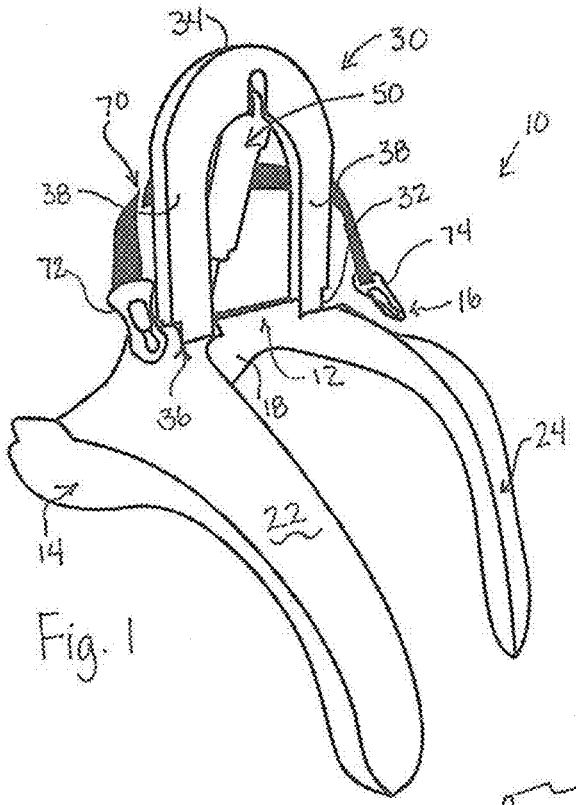
FIG. 1 is a perspective view of the head restraint device of the invention.

Referring to the figures, head protective device 10 is shown. Head protective device 10 includes collar portion 12 having right side 14, left side 16, neck facing side 18 (FIG. 1), and rear side 20. Right leg 22 is connected to right side 14 of collar portion 12. Right leg 22 extends forwardly and downwardly from right side 14 of collar portion 12.

Left leg 24 is connected to left side 16 of collar portion 12. Left leg 24 extends forwardly and downwardly from left side 16 of collar portion 12. In a preferred embodiment, collar portion 12, right leg 22, and left leg 24 are constructed of a single solid piece.

Upwardly extending head rest portion 30 is movably affixed to collar portion 12. Upwardly extending head rest portion 30 has base end 32. Base end 32 is adjacent to central collar portion 12. Upwardly extending head rest portion 30 additionally defines an upper end 34. In one embodiment, base end 32 is hingedly affixed to collar portion 12 with hinge member 36 (FIG. 1). In one embodiment, upwardly extended head rest portion 30 may be flexibly attached to collar portion 12 while relying on flexible properties of materials used to form upper head rest portion 30 and collar portion 12.

In one embodiment, upwardly extending head rest portion 30 is constructed in a U shape that defines downwardly extending legs 38 wherein lower ends of downwardly extending legs 38 define base end 32. In one embodiment, upwardly extending head rest portion 30 further comprises connecting rod 40 (FIG. 2) that is affixed to upper head rest portion 30 proximate upper end 34. In one embodiment, connecting rod 40 extends across a gap defined by the U shaped upper head rest portion 30 so that a center portion of connecting rod 40 is exposed.

Figure 2:
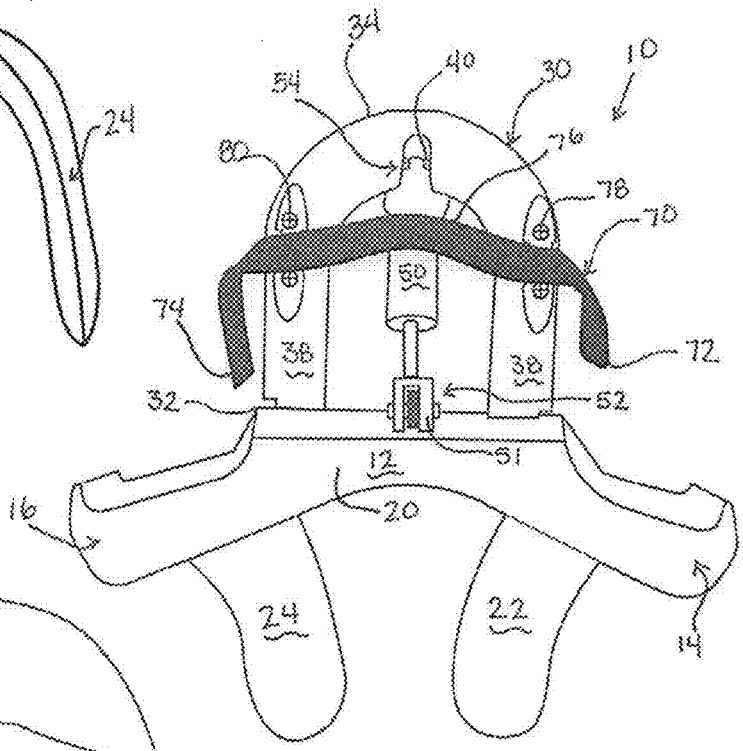
FIG. 2 is a rear elevation view of a head restraint device of FIG. 1.

Shock absorbing mechanism 50 is provided for resisting forward motion of upwardly extending head rest portion 30. Shock absorbing mechanism 50 has a lower end 52 that may be affixed to collar portion 12, e.g., with attachment bracket 51 (FIG. 2). Shock absorbing mechanism 50 has upper end 54 (FIG. 2) that is affixed to upwardly extending head rest portion 30. Upper end 54 of shock absorbing member 50 may be affixed to the center portion of connecting rod 40. In one embodiment, shock absorbing member 50 is a piston and cylinder. However, shock absorbing mechanism 50 may be constructed in other ways. For example, shock absorbing mechanism 50 may be constructed of a spring member, which may be a coil spring or elastomeric member or other shock absorbing mechanisms may be employed to absorb shock imparted by rapid deceleration of a user's head.

In one embodiment, shock absorber member 50 is a predominantly metal closed hydraulic dampening device constructed of an external body, a shaft, a shaft to body seal, a fluid control piston, and fluid control metal piston shims. When assembled, a viscous fluid is contained around the piston, shaft, and shims inside the body and sealed by the shaft to body seal.

In one embodiment, shock absorber member 50 absorbs energy by creating resistance to input forces in both the compression and extension direction. This is achieved by metering the fluid flow through piston. As the shaft with piston is forced through the fluid in either direction, the piston, piston shims, and metering slots work together to slow down the shaft. This is done progressively based on piston port size and shape, shim diameters and thickness, the order in which the shims are stacked over piston ports, size and quantity of metering slots, and viscosity of fluid. Characteristics of shock absorber member 50 may be modified by manipulating these items. Therefore, an object may be slowed down in a progressive manner minimizing or eliminating the possibility of damage to the object.

Figure 3:
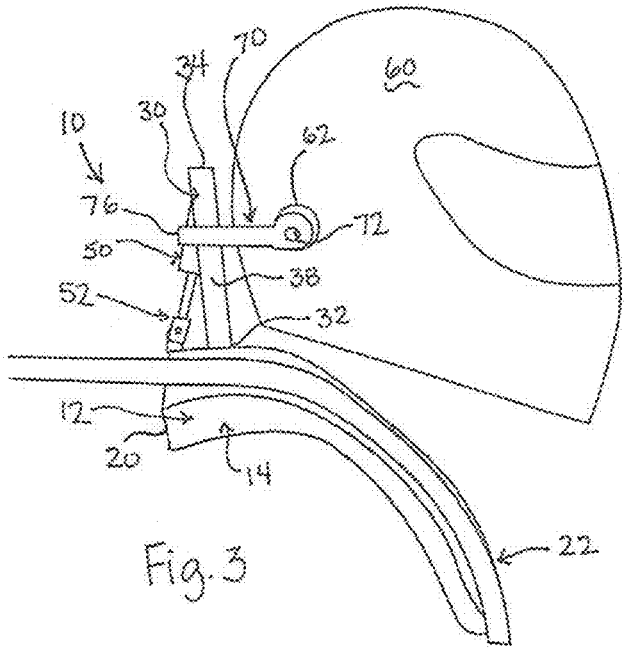
FIG. 3 is a side elevation view of a head restraint device of FIG. 1, shown attached to a helmet.
Figure 4:
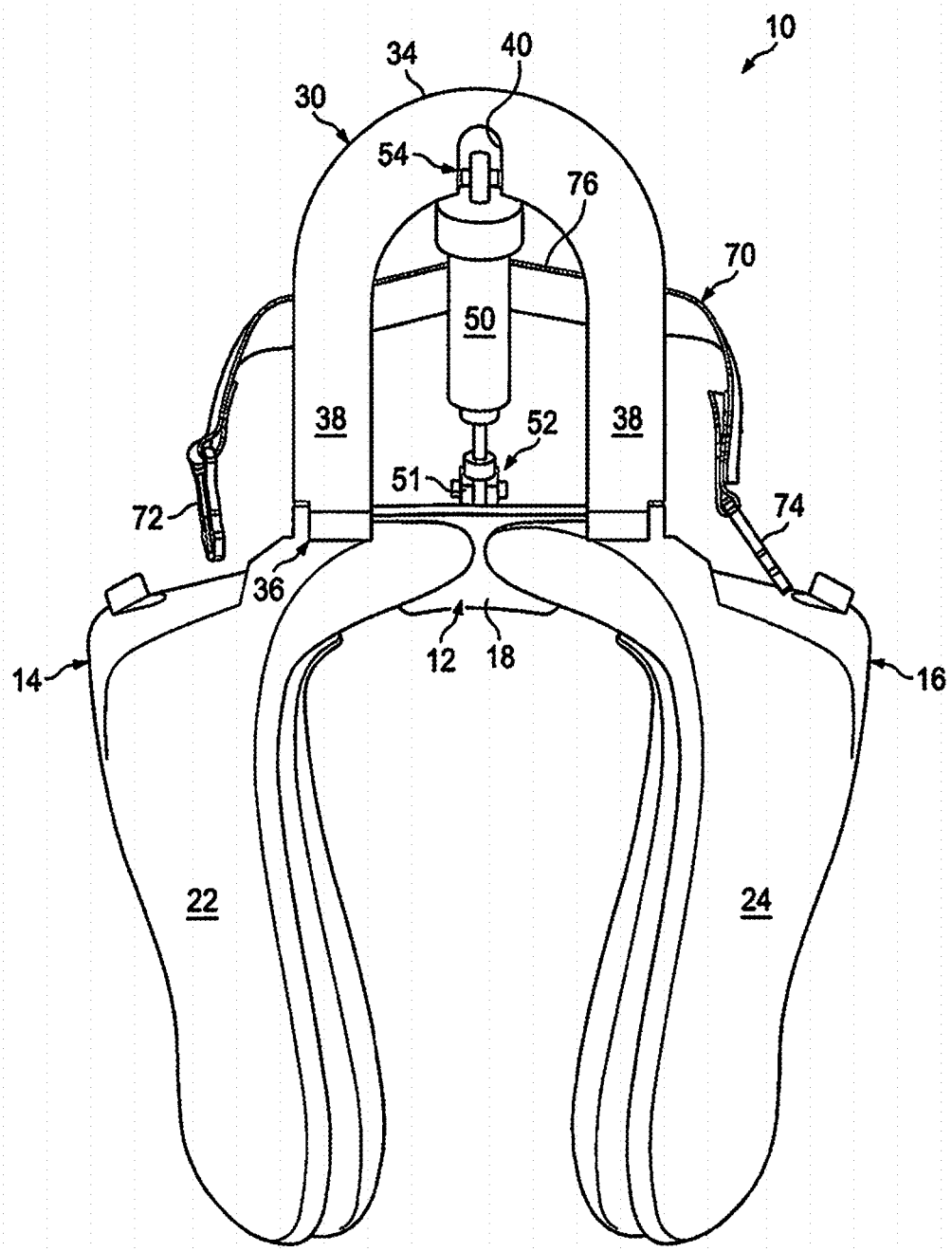
FIG. 4 is a photograph of a front elevation view of a head restraint device of the invention.

A user's head is typically protected by helmet 60 (FIG. 3). Helmet 60 defines at least one connection point thereon. In one embodiment, helmet 60 defines a first connection location 62 and a similar second connection location (not shown) on the opposite side of helmet 60. Strap 70 is provided having first end 72, second end 74, and central portion 76. Central portion 76 may be affixed to upwardly extending head rest portion 30, e.g., at right bracket 78 and left bracket 80 (FIG. 2), while first end 72 is affixed to first connection location 62 on helmet 60 and second end 74 is affixed to the second connection location on helmet 60. Other connection configurations may also be possible including the implementation of a strap having a single connection point to helmet 60 or other rigid mechanisms may also be deployed.

Thus, the present invention is well adapted to carry out the objectives and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within the spirit of this invention as defined by the claims.

What is claimed is:

1. A protective device for a driver of a vehicle comprising:
a collar portion having a right side and a left side;
a right leg connected to said right side of said collar portion and extending forwardly and downwardly from said right side of said collar portion;
a left leg connected to said left side of said collar portion and extending forwardly and downwardly from said left side of said collar portion;
an upwardly extending portion movably affixed to said collar portion, said upwardly extending portion having a base end adjacent said collar portion and having an upper end;
a shock absorber for resisting forward motion of said upwardly extending portion, said shock absorber having a first end affixed to said collar portion, said shock absorber having a second end affixed to said upwardly extending portion;
a connector for communicating said upwardly extending portion to a helmet.

2. The device of claim 1 wherein:
said collar portion, said right leg and said left leg are constructed of a single piece.

3. The device of claim 1 wherein:
said upwardly extending portion is hingedly affixed to said collar portion.

4. The device of claim 1 wherein:
said upwardly extending portion is flexibly attached to said collar portion.

5. The device of claim 1 wherein:
said upwardly extending portion has a U-shape defining downwardly extending legs affixed to said collar portion.

6. The device of claim 1 further comprising:
a connecting rod proximate said upper end of said upwardly extending portion.

7. The device of claim 6 wherein:
said second end of said shock absorber is connected to said connecting rod.

8. The device of claim 1 wherein:
said collar portion is sized for positioning behind a neck of a wearer, wherein said right leg and said left leg are configured for passing over a shoulder of a wearer and downward in front of a torso of a wearer, and wherein said upwardly extending portion is configured for locating behind a head of a wearer.

9. The device of claim 1 wherein:
said shock absorber is a piston and cylinder.
10. The device of claim 1 wherein:
said shock absorber comprises a spring member.
11. The device of claim 1 wherein:
said shock absorber is a coil spring.
12. The device of claim 1 wherein:
said shock absorber is an elastomeric member.
13. The device of claim 1 wherein:
said connector is a strap that connects said upwardly extending portion with a helmet.
14. The device of claim 13 wherein:
said strap has a first end, a central portion, and a second end, said central portion of said strap affixed to said upwardly extending portion, said first end for affixing to a first connection location on a helmet, said second end for affixing to a second connection location on a helmet.
15. A method of slowing deceleration of a helmet during a crash comprising the steps of:
locating a collar portion behind a neck of a wearer with a right leg and a left leg extending over the shoulders of the wearer;
locating an upwardly extending portion behind a head of the wearer, wherein said upwardly extending portion is movably affixed to said collar portion;
connecting said upwardly extending portion to a helmet;
resisting forward motion of said upwardly extending portion for slowing forward movement of said upwardly extending portion and said helmet during rapid deceleration of the wearer.
16. The method according to claim 15 wherein:
said collar portion, said right leg and said left leg are constructed of a single piece.
17. The method according to claim 15 wherein:
wherein said upwardly extending portion is hingedly affixed to said collar portion.
18. The method according to claim 15 wherein:
said upwardly extending portion is flexibly attached to said collar portion.
19. The method according to claim 15 wherein:
said step of resisting comprises resisting forward motion of said upwardly extending portion with a shock absorber.
20. The method according to claim 19 wherein:
said shock absorber has a lower end affixed to said collar portion, said shock absorber having an upper end affixed to said upwardly extending portion.
21. The method according to claim 19 wherein:
said shock absorber resists forward motion of said upwardly extending portion by manipulating a piston and cylinder.
22. The method according to claim 19 wherein:
said shock absorber resists forward motion of said upwardly extending portion by resisting deformation of a spring member.
23. The method according to claim 19 wherein:
said shock absorber resists forward motion of said upwardly extending portion by resisting deformation of an elastomeric member.
24. The method according to claim 15 wherein:
said step of connecting comprises connecting said upwardly extending portion to a helmet with a strap.
25. The method according to claim 24 wherein:
said step of connecting comprises affixing a central portion of said strap to said upwardly extending portion and affixing a first end and a second end of said strap to a helmet.
26. A method of slowing deceleration of a helmet during a crash comprising the steps of:
locating a collar portion behind a neck of a wearer with a right leg and a left leg extending over the shoulders of the wearer;
locating an upwardly extending portion behind a head of the wearer, wherein said upwardly extending portion is movably affixed to said collar portion;
connecting said upwardly extending portion to a helmet;
resisting forward motion of said upwardly extending portion for slowing forward movement of said upwardly extending portion and said helmet during rapid deceleration of the wearer; and
wherein said upwardly extending portion is hingedly affixed to said collar portion.
27. A method of slowing deceleration of a helmet during a crash comprising the steps of:
locating a collar portion behind a neck of a wearer with a right leg and a left leg extending over the shoulders of the wearer;
locating an upwardly extending portion behind a head of the wearer, wherein said upwardly extending portion is pivotally affixed to said collar portion;
connecting said upwardly extending portion to a helmet;
resisting forward motion of said upwardly extending portion for slowing forward movement of said upwardly extending portion and said helmet during rapid deceleration of the wearer; and
wherein said step of resisting comprises resisting forward motion of said upwardly extending portion with a shock absorber.
28. A method of slowing deceleration of a helmet during a crash comprising the steps of:
locating a collar portion behind a neck of a wearer with a right leg and a left leg extending over the shoulders of the wearer;
locating an upwardly extending portion behind a head of the wearer, wherein said upwardly extending portion is pivotally affixed to said collar portion;
connecting said upwardly extending portion to a helmet;
resisting forward motion of said upwardly extending portion for slowing forward movement of said upwardly extending portion and said helmet during rapid deceleration; and
wherein said step of connecting comprises connecting said upwardly extending portion to a helmet with a strap.
29. The method according to claim 15 wherein:
said upwardly extending portion is pivotally affixed to said collar portion.

* * * * *